US012618198B2

(12) United States Patent
Clark et al.

(10) Patent No.: US 12,618,198 B2
(45) Date of Patent: May 5, 2026

(54) BARRIER RECYCLED PAPERBOARD AND METHOD FOR MANUFACTURING THEREOF

(71) Applicant: WESTROCK MWV, LLC, Atlanta, GA (US)

(72) Inventors: Terry L. Clark, Columbus, GA (US); Scott J. Reigle, Columbus, GA (US); Jiebin Pang, Glen Allen, VA (US); William G. Deats, Macungie, PA (US)

(73) Assignee: WestRock MWV, LLC, Atlanta, GA (US)

( * ) Notice: Subject to any disclaimer, the term of this patent is extended or adjusted under 35 U.S.C. 154(b) by 174 days.

(21) Appl. No.: 17/912,806

(22) PCT Filed: Mar. 8, 2021

(86) PCT No.: PCT/US2021/021304

§ 371 (c)(1),
(2) Date: Sep. 19, 2022

(87) PCT Pub. No.: WO2021/188312

PCT Pub. Date: Sep. 23, 2021

(65) Prior Publication Data

US 2023/0175206 A1 Jun. 8, 2023

Related U.S. Application Data

(60) Provisional application No. 62/992,305, filed on Mar. 20, 2020.

(51) Int. Cl.
*D21H 19/82* (2006.01)
*B65D 65/42* (2006.01)
(Continued)

(52) U.S. Cl.
CPC ..... *D21H 19/822* (2013.01); *B65D 65/42* (2013.01); *D21H 11/14* (2013.01); *D21H 19/40* (2013.01);
(Continued)

(58) Field of Classification Search
CPC ..... D21H 19/822; D21H 11/14; D21H 19/40; D21H 19/54; D21H 19/60; D21H 23/34; D21H 23/56; D21H 27/10; B65D 65/42
See application file for complete search history.

(56) References Cited

U.S. PATENT DOCUMENTS 5,989,724 A 11/1999 Wittosch et al.
6,740,373 B1 * 5/2004 Swoboda ..... D21H 27/30 428/514
(Continued)

FOREIGN PATENT DOCUMENTS

CN 107208379 A 9/2017
EP 2682523 A1 1/2014
(Continued)

OTHER PUBLICATIONS

International Search Report Issued in PCT/US21/21304 dated Jun. 7, 2021.
Chinese Search Report dated Jul. 14, 2023, 3 pages.

*Primary Examiner* — Dennis R Cordray
(74) *Attorney, Agent, or Firm* — Neil G. Cohen; Rohini K. Garg

(57) ABSTRACT

A coated paperboard includes a recycled paperboard substrate having a first side and a second side, a first aqueous barrier coating applied over the first side, and a second aqueous barrier coating applied over the first aqueous barrier coating. The first aqueous barrier coating is formed from a mixture of binder and pigment. The second aqueous barrier coating is formed from a mixture of binder and pigment.

25 Claims, 1 Drawing Sheet

(51) Int. Cl.

| | |
|---|---|
| ***D21H 11/14*** | (2006.01) |
| ***D21H 19/40*** | (2006.01) |
| ***D21H 19/54*** | (2006.01) |
| ***D21H 19/60*** | (2006.01) |
| ***D21H 23/34*** | (2006.01) |
| ***D21H 23/56*** | (2006.01) |

(52) U.S. Cl.
CPC ..... *D21H 19/54* (2013.01); *D21H 19/60* (2013.01); *D21H 23/34* (2013.01); *D21H 23/56* (2013.01)

(56) References Cited

U.S. PATENT DOCUMENTS

| | | | | |
|---|---|---|---|---|
| 10,415,188 | B1 | 9/2019 | Knauf et al. | |
| 2005/0112387 | A1* | 5/2005 | Druckrey ..... | D21H 19/82<br>428/452 |
| 2016/0230343 | A1 | 8/2016 | Pang et al. | |
| 2019/0127917 | A1* | 5/2019 | Pang ..... | D21H 19/58 |
| 2019/0257034 | A1 | 8/2019 | Pang et al. | |

FOREIGN PATENT DOCUMENTS

| | | | |
|---|---|---|---|
| EP | 3178648 | A1 | 6/2017 |
| WO | 2005044469 | A1 | 5/2005 |

* cited by examiner

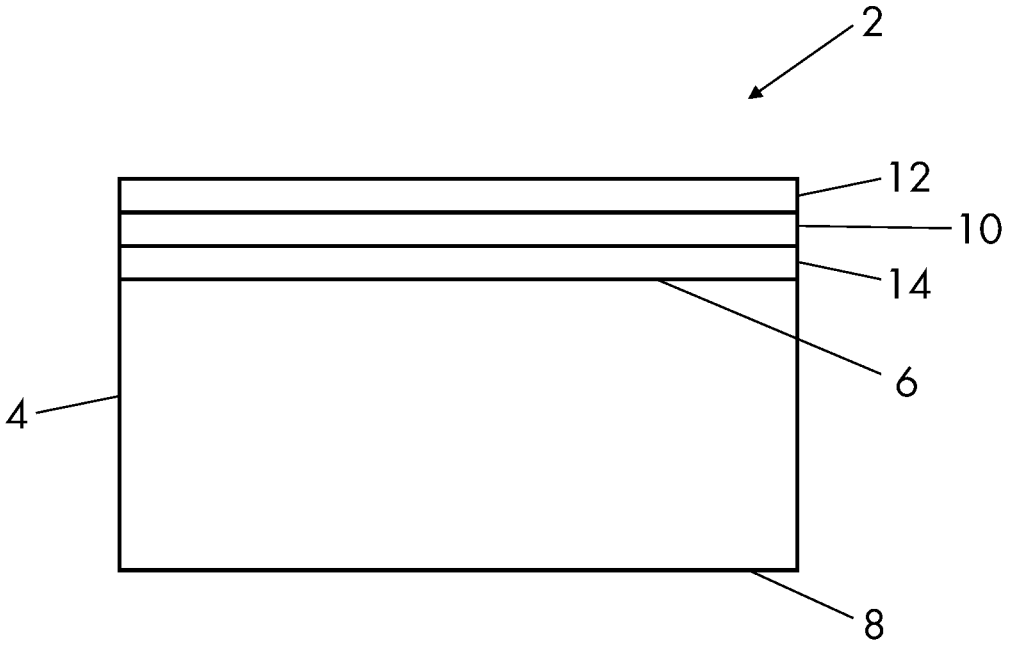
2
12
10
14
6
4
8

BARRIER RECYCLED PAPERBOARD AND METHOD FOR MANUFACTURING THEREOF

PRIORITY

This application claims priority from U.S. Ser. No. 62/992,305 filed on Mar. 20, 2020.

FIELD

The present application relates to the field of recycled paperboard substrates having enhanced barrier properties.

BACKGROUND

Food or food service containers using paperboard often require enhanced barrier properties of the paperboard, including oil, grease, moisture, vapor, and/or oxygen barrier. Polyethylene extrusion coating and specialty chemical (wax, fluorochemicals, etc.) treatment have been employed to provide oil and grease resistance to paperboard containers. However, paperboard treated with wax or coated with polyethylene, which is often used in oil and grease resistant packaging, has difficulties in repulping and is not as easily recyclable as conventional paperboard. Paperboard treated with specialty chemicals such as fluorochemicals have potential health, safety, and environment concerns. Sustainable and environmentally friendly packaging is increasingly demanded for containers for food or food service packaging.

Accordingly, those skilled in the art continue with research and development in the field of paperboard substrates having enhanced barrier properties and sustainability.

SUMMARY

In one embodiment, a coated paperboard includes a recycled paperboard substrate having a first side and a second side, a first aqueous barrier coating applied over the first side, and a second aqueous barrier coating applied over the first aqueous barrier coating. The first aqueous barrier coating is formed from a mixture of binder and pigment. The second aqueous barrier coating is formed from a mixture of binder and pigment.

In another embodiment, there is a method for manufacturing coated paperboard. The method includes applying a first aqueous barrier coating over a first side of a recycled paperboard substrate and applying a second aqueous barrier coating over the first aqueous barrier coating. The first aqueous barrier coating is formed from a mixture of binder and pigment. The second aqueous barrier coating is formed from a mixture of binder and pigment.

In yet another embodiment, a coated paperboard includes a recycled paperboard substrate having a first side and a second side and a first aqueous barrier coating applied over the first side. The first aqueous barrier coating is formed from a mixture of binder and pigment.

In yet another embodiment, there is a method for manufacturing coated paperboard. The method includes applying a first aqueous barrier coating over a first side of a recycled paperboard substrate. The first aqueous barrier coating is formed from a mixture of binder and pigment.

Other embodiments of the disclosed coated paperboard and method for manufacturing a coated paperboard will become apparent from the following detailed description, the accompanying drawings, and the appended claims.

BRIEF DESCRIPTION OF THE DRAWING

FIG. 1 is a cross-section of a portion of a coated paperboard according to an exemplary embodiment of the present description.

DETAILED DESCRIPTION

FIG. 1 is a cross-section of a portion of a coated paperboard 2 according to an exemplary embodiment of the present description. As shown in FIG. 1, the coated paperboard 2 includes a recycled paperboard substrate 4 having a first side 6 and a second side 8, a first aqueous barrier coating 10 applied over the first side 6, and a second aqueous barrier coating 12 applied over the first aqueous barrier coating 10. According to another exemplary embodiment of the present description, the second aqueous barrier coating 12 may be omitted. The coated paperboard 2 may further include a basecoat 14 between the first side 6 of the recycled paperboard substrate 4 and the first aqueous barrier coating 10. The coated paperboard 2 may further include additional layers on the first side 6 of the recycled paperboard substrate 4, such as, for example, a third aqueous barrier coating applied over the second aqueous barrier coating 12. The third aqueous barrier coating may have the same or different characteristics than the first aqueous barrier coating 10 and the second aqueous barrier coating 12. Additionally, the coated paperboard 2 may further include additional layers on the second side 8 of the recycled paperboard substrate 4. These additional layers may the same or different layers than the first side 6 of the recycled paperboard substrate 4.

Recycled paperboard substrates are produced from fibers recovered from paper waste, thereby providing for a sustainable paperboard product. In an expression, the recycled paperboard substrate 4 of the present description is produced from at least 1%, by weight, recovered fibers. In another expression, the recycled paperboard substrate 4 of the present description is produced from at least 5%, by weight, recovered fibers. In yet another expression, the recycled paperboard substrate 4 of the present description is produced from at least 10%, by weight, recovered fibers. In yet another expression, the recycled paperboard substrate 4 of the present description is produced from at least 20%, by weight, recovered fibers. In yet another expression, the recycled paperboard substrate 4 of the present description is produced from at least 30%, by weight, recovered fibers. In yet another expression, the recycled paperboard substrate 4 of the present description is produced from at least 40%, by weight, recovered fibers. In yet another expression, the recycled paperboard substrate 4 of the present description is produced from at least 50%, by weight, recovered fibers. In yet another expression, the recycled paperboard substrate 4 of the present description is produced from at least 60%, by weight, recovered fibers. In yet another expression, the recycled paperboard substrate 4 of the present description is produced from at least 70%, by weight, recovered fibers. In yet another expression, the recycled paperboard substrate 4 of the present description is produced from at least 80%, by weight, recovered fibers. In yet another expression, the recycled paperboard substrate 4 of the present description is produced from at least 85%, by weight, recovered fibers. In yet another expression, the recycled paperboard substrate 4 of the present description is produced from at least 90%, by weight, recovered fibers. In yet another expression, the recycled paperboard substrate 4 of the present description is produced from at least 95%, by weight, recovered fibers. In yet another expression, the recycled paperboard substrate 4 of the present description is produced from at least 99%, by weight, recovered fibers. In yet another expression, the recycled paperboard substrate 4 of the present description is produced from 100% recovered fibers. Recycled paperboard substrates having a high amount of recovered fibers are more sustainable.

The caliper thickness of the recycled paperboard substrate 4 may depend on a variety of factors. In an aspect, the caliper thickness is at least 4 points (0.004 inch). In another aspect, the caliper thickness is at least 8 points (0.004 inch). In yet another aspect, the caliper thickness is at least 10 points (0.010 inch). In yet another aspect, the caliper thickness is at least 12 points (0.012 inch). In yet another aspect, the caliper thickness is at least 14 points (0.014 inch). In an expression, the recycled paperboard substrate has a caliper thickness of ranging from 4 points to 36 points (0.004 inch to 0.036 inch). In another expression, the recycled paperboard substrate 4 has a caliper thickness of ranging from 10 points to 30 points (0.010 inch to 0.030 inch). In yet another expression, the recycled paperboard substrate 4 has a caliper thickness of ranging from 18 points to 28 points (0.018 inch to 0.028 inch). In yet another expression, the recycled paperboard substrate 4 has a caliper thickness of ranging from 20 points to 26 points (0.020 inch to 0.026 inch).

In an aspect, the coated paperboard 2 includes basecoat 14 between the first side 6 of the recycled paperboard substrate 4 and the first aqueous barrier coating 10.

The basecoat 14 may be formed from a mixture of binder and pigment. In an example, the binder of the basecoat 14 may be present in the mixture in an amount of 5-35 parts per 100 parts of pigment by weight. In another example, the binder of the basecoat 14 may be present in the mixture in an amount of 10-20 parts per 100 parts of pigment by weight. In yet another example, the binder of the basecoat 14 may be present in the mixture in an amount of 15-25 parts per 100 parts of pigment by weight. For example, the binder of the basecoat may include a latex binder, a natural binder, or a latex binder and natural binder. The pigment of the basecoat may include one or more of clay, calcium carbonate, and titanium oxide. In an example, the pigment of the basecoat includes clay, such as kaolin clay. In an aspect, the basecoat contains substantially no fluorochemical. In another aspect, the basecoat contains substantially no wax. In yet another aspect, the basecoat contains substantially no polyethylene.

In an expression, the basecoat may have a coat weight from 2 to 14 pounds per 3000 $ft^2$. In another expression, the basecoat may have a coat weight from 4 to 12 pounds per 3000 $ft^2$. In yet another expression, the basecoat may have a coat weight from 6 to 10 pounds per 3000 $ft^2$.

According to the present description, the first aqueous barrier coating is formed from a mixture of binder and pigment. In an aspect, the binder of the first aqueous barrier coating is present in the mixture in an amount of 30 to 50 parts per 100 parts of pigment by weight. In another aspect, the binder of the first aqueous barrier coating is present in the mixture in an amount of 36 to 45 parts per 100 parts of pigment by weight. In yet another aspect, the binder of the first aqueous barrier coating is present in the mixture in an amount of 37 to 44 parts per 100 parts of pigment by weight. In yet another aspect, the binder of the first aqueous barrier coating is present in the mixture in an amount of 38 to 43 parts per 100 parts of pigment by weight. In yet another aspect, the binder of the first aqueous barrier coating is present in the mixture in an amount of 39 to 42 parts per 100 parts of pigment by weight. In yet another aspect, the binder of the first aqueous barrier coating is present in the mixture in an amount of 40 to 41 parts per 100 parts of pigment by weight. The binder of the first aqueous barrier coating may be a latex binder. The latex binder of the first aqueous barrier coating may include, for example, one or more of vinyl acrylic copolymer, polyvinyl acetate, styrene acrylate copolymer, acrylic, vinyl acetate-ethylene copolymer, polyvinyl alcohol, and styrene butadiene copolymer.

The first aqueous barrier coating may further include a natural co-binder. In an example, the natural co-binder may be present in the mixture in an amount of up to 16 parts per 100 parts of pigment by weight. In another example, the natural co-binder may be present in the mixture in an amount of up to 8 parts per 100 parts of pigment by weight. In yet another example, the natural co-binder may be present in the mixture in an amount of up to 4 parts per 100 parts of pigment by weight. In yet another example, the natural co-binder may be present in the mixture in an amount of 1 to 4 parts per 100 parts of pigment by weight. The natural co-binder may be a starch or protein co-binder.

The first aqueous barrier coating may further include an additive. In an example, the additive may be present in the mixture in an amount of up to 4 parts per 100 parts of pigment by weight. In another example, the additive may be present in the mixture in an amount of up to 2 parts per 100 parts of pigment by weight. In yet another example, the additive may be present in the mixture in an amount of up to 1 part per 100 parts of pigment by weight. In yet another example, the additive may be present in the mixture in an amount of up to 0.7 parts per 100 parts of pigment by weight. In yet another example, the additive may be present in the mixture in an amount of up to 0.1 to 0.7 parts per 100 parts of pigment by weight.

The additive may include a viscosity modifier. In an example, the viscosity modifier may be present in the mixture in an amount of 0.1 to 4.0 parts per 100 parts of pigment by weight. In another example, the viscosity modifier may be present in the mixture in an amount of 0.2 to 2.0 parts per 100 parts of pigment by weight. In yet another example, the viscosity modifier may be present in the mixture in an amount of 0.3 to 1.0 parts per 100 parts of pigment by weight. In yet another example, the viscosity modifier may be present in the mixture in an amount of 0.4 to 0.8 parts per 100 parts of pigment by weight. In yet another example, the viscosity modifier may be present in the mixture in an amount of 0.5 to 0.7 parts per 100 parts of pigment by weight. The viscosity modifier may include an alkali-swellable emulsion or any other type of viscosity modifier.

The additive may include an insolubilizer. In an example, the insolubilizer may be present in the mixture in an amount of 0.01 to 2.0 parts per 100 parts of pigment by weight. In another example, the insolubilizer may be present in the mixture in an amount of 0.02 to 1.0 parts per 100 parts of pigment by weight. In yet another example, the insolubilizer may be present in the mixture in an amount of 0.05 to 0.5 parts per 100 parts of pigment by weight. In yet another example, the insolubilizer may be present in the mixture in an amount of 0.1 to 0.25 parts per 100 parts of pigment by weight. The insolubilizer may include ammonium zirconium carbonate, glyoxal, or potassium zirconium carbonate.

The pigment of the first aqueous barrier coating may include one or more of clay, calcium carbonate, and titanium oxide. For example, the pigment of the first aqueous barrier coating may include clay, such as kaolin clay.

In an aspect, the first aqueous barrier coating contains substantially no fluorochemical. In another aspect, the first aqueous barrier coating contains substantially no wax. In yet another aspect, the first aqueous barrier coating contains substantially no polyethylene.

In an expression, the first aqueous barrier coating has a coat weight from 5 to 15 pounds per 3000 $ft^2$. In another expression, the first aqueous barrier coating has a coat weight from 7 to 13 pounds per 3000 $ft^2$. In yet another expression, the first aqueous barrier coating has a coat weight from 9 to 11 pounds per 3000 $ft^2$.

According to the present description, the second aqueous barrier coating is formed from a mixture of binder and pigment. In an aspect, the binder of the second aqueous barrier coating is present in the mixture in an amount of 30 to 50 parts per 100 parts of pigment by weight. In another aspect, the binder of the second aqueous barrier coating is present in the mixture in an amount of 36 to 45 parts per 100 parts of pigment by weight. In yet another aspect, the binder of the second aqueous barrier coating is present in the mixture in an amount of 37 to 44 parts per 100 parts of pigment by weight. In yet another aspect, the binder of the second aqueous barrier coating is present in the mixture in an amount of 38 to 43 parts per 100 parts of pigment by weight. In yet another aspect, the binder of the second aqueous barrier coating is present in the mixture in an amount of 39 to 42 parts per 100 parts of pigment by weight. In yet another aspect, the binder of the second aqueous barrier coating is present in the mixture in an amount of 40 to 41 parts per 100 parts of pigment by weight. The binder of the second aqueous barrier coating may be a latex binder. The latex binder of the second aqueous barrier coating may include, for example, one or more of vinyl acrylic copolymer, polyvinyl acetate, styrene acrylate copolymer, acrylic, vinyl acetate-ethylene copolymer, polyvinyl alcohol, and styrene butadiene copolymer.

The second aqueous barrier coating may further include a natural co-binder. In an example, the natural co-binder may be present in the mixture in an amount of up to 16 parts per 100 parts of pigment by weight. In another example, the natural co-binder may be present in the mixture in an amount of up to 8 parts per 100 parts of pigment by weight. In yet another example, the natural co-binder may be present in the mixture in an amount of up to 4 parts per 100 parts of pigment by weight. In yet another example, the natural co-binder may be present in the mixture in an amount of 1 to 4 parts per 100 parts of pigment by weight. The natural co-binder may be a starch or protein co-binder.

The second aqueous barrier coating may further include an additive. In an example, the additive may be present in the mixture in an amount of up to 4 parts per 100 parts of pigment by weight. In another example, the additive may be present in the mixture in an amount of up to 2 parts per 100 parts of pigment by weight. In yet another example, the additive may be present in the mixture in an amount of up to 1 part per 100 parts of pigment by weight. In yet another example, the additive may be present in the mixture in an amount of up to 0.7 parts per 100 parts of pigment by weight. In yet another example, the additive may be present in the mixture in an amount of up to 0.1 to 0.7 parts per 100 parts of pigment by weight.

The additive may include a viscosity modifier. In an example, the viscosity modifier may be present in the mixture in an amount of 0.1 to 4.0 parts per 100 parts of pigment by weight. In another example, the viscosity modifier may be present in the mixture in an amount of 0.2 to 2.0 parts per 100 parts of pigment by weight. In yet another example, the viscosity modifier may be present in the mixture in an amount of 0.3 to 1.0 parts per 100 parts of pigment by weight. In yet another example, the viscosity modifier may be present in the mixture in an amount of 0.4 to 0.8 parts per 100 parts of pigment by weight. In yet another example, the viscosity modifier may be present in the mixture in an amount of 0.5 to 0.7 parts per 100 parts of pigment by weight. The viscosity modifier may include an alkali-swellable emulsion or any other type of viscosity modifier.

The additive may include an insolubilizer. In an example, the insolubilizer may be present in the mixture in an amount of 0.01 to 2.0 parts per 100 parts of pigment by weight. In another example, the insolubilizer may be present in the mixture in an amount of 0.02 to 1.0 parts per 100 parts of pigment by weight. In yet another example, the insolubilizer may be present in the mixture in an amount of 0.05 to 0.5 parts per 100 parts of pigment by weight. In yet another example, the insolubilizer may be present in the mixture in an amount of 0.1 to 0.25 parts per 100 parts of pigment by weight. The insolubilizer may include ammonium zirconium carbonate, glyoxal, or potassium zirconium carbonate.

The pigment of the second aqueous barrier coating may include one or more of clay, calcium carbonate, and titanium oxide. For example, the pigment of the second aqueous barrier coating may include clay, such as kaolin clay.

In an aspect, the second aqueous barrier coating contains substantially no fluorochemical. In another aspect, the second aqueous barrier coating contains substantially no wax. In yet another aspect, the second aqueous barrier coating contains substantially no polyethylene.

In an expression, the second aqueous barrier coating has a coat weight from 5 to 15 pounds per 3000 $ft^2$. In another expression, the second aqueous barrier coating has a coat weight from 7 to 13 pounds per 3000 $ft^2$. In yet another expression, the second aqueous barrier coating has a coat weight from 9 to 11 pounds per 3000 $ft^2$.

Thus, in an aspect, the second aqueous barrier coating may have the same or different composition as that of the first aqueous barrier coating.

In an aspect, the coated paperboard of the present description has a 3M kit test value of at least 5. In another aspect, the coated paperboard of the present description has a 3M kit test value of at least 6. In yet another aspect, the coated paperboard of the present description has a 3M kit test value of at least 7. In yet another aspect, the coated paperboard of the present description has a 3M kit test value of at least 8. In yet another aspect, the coated paperboard of the present description has a 3M kit test value of at least 9. In yet another aspect, the coated paperboard of the present description has a 3M kit test value of at least 10. In yet another aspect, the coated paperboard of the present description has a 3M kit test value of at least 11. The oil and grease resistance (OGR) is measured on the 'barrier side' by the 3M kit test (TAPPI Standard T559 cm-02). With this test, ratings are from 1 (the least resistance to oil and grease) to 12 (excellent resistance to oil and grease penetration).

In an aspect, the coated paperboard of the present description has a 30-minute oil Cobb test of at most 5 grams per square meter. In another aspect, the coated paperboard of the present description has a 30-minute oil Cobb test of at most 3 grams per square meter. In another aspect, the coated paperboard of the present description has a 30-minute oil Cobb test of at most 2 grams per square meter. In another aspect, the coated paperboard of the present description has a 30-minute oil Cobb test of at most 1 gram per square meter. Oil absorptiveness (oil Cobb) is used to quantify and compare the OGR performance (oil and grease resistance), which measures the mass of oil absorbed in a specific time, e.g., 30 minutes, by 1 square meter of coated paperboard.

For each condition tested, the sample was cut to provide two pieces each 6-inch×6-inch square. Each square sample was weighed just before the test. Then a 4-inch×4-inch (area of 16 square inches or 0.0103 square meters) square of blotting paper saturated with peanut oil was put on the center of the test specimen (barrier side) and pressed gently to make sure the full area of oily blotting paper was contacting the coated surface. After 30-minutes as monitored by a stopwatch, the oily blotting paper was gently removed using tweezers, and the excess amount of oil was wiped off from the coated surface using paper wipes (KIMWIPES). Then the test specimen was weighed again. The weight difference in grams before and after testing divided by the test area of 0.0103 square meters gave the oil Cobb value in grams/square meter.

In an aspect, the coated paperboard of the present description has a 2-min water Cobb less than 60 grams per square meter. In another aspect, the coated paperboard of the present description has a 2-min water Cobb less than 50 grams per square meter. In yet another aspect, the coated paperboard of the present description has a 2-min water Cobb less than 45 grams per square meter. In yet another aspect, the coated paperboard of the present description has a 2-min water Cobb less than 40 grams per square meter. The water barrier is evaluated by water Cobb (TAPPI Standard T441 om-04) in g/m2 per 2 minutes, using 23° C. water.

In an aspect, the coated paperboard of the present description has a water vapor transmission rate of less than 800 grams per square meter per day. In another aspect, the coated paperboard of the present description has a water vapor transmission rate of less than 700 grams per square meter per day. In yet another aspect, the coated paperboard of the present description has a water vapor transmission rate of less than 650 grams per square meter per day. In yet another aspect, the coated paperboard of the present description has a water vapor transmission rate of less than 600 grams per square meter per day. In yet another aspect, the coated paperboard of the present description has a water vapor transmission rate of less than 550 grams per square meter per day. The moisture vapor barrier is evaluated by WVTR (water vapor transmission rate) at 38° C. and 90% relative humidity following TAPPI Standard T464 OM-12.

In an aspect, the coated paperboard of the present description is repulpable to the extent that after repulping the percentage accepts is at least 85%. In another aspect, the coated paperboard of the present description is repulpable to the extent that after repulping the percentage accepts is at least 90%. In yet another aspect, the coated paperboard of the present description is repulpable to the extent that after repulping the percentage accepts is at least 95%. In yet another aspect, the coated paperboard of the present description is repulpable to the extent that after repulping the percentage accepts is at least 97%. In yet another aspect, the coated paperboard of the present description is repulpable to the extent that after repulping the percentage accepts is at least 98%. Repulpability is tested using an AMC Maelstom repulper. 110 grams of coated paperboard, cut into 1"×1" squares, is added to the repulper containing 2895 grams of water (pH of 6.5±0.5, 50 degrees C.), soaked for 15 minutes, and then repulped for 30 minutes. 300 mL of the repulped slurry is then screened through a Vibrating Flat Screen (0.006" slot size). Rejects (caught by the screen) and fiber accepts are collected, dried, and weighed. The percentage of accepts is calculated based on the weights of accepts and rejects, with 100% being complete repulpability.

The coated paperboard of the present description may be produced into a container, such as a food packaging container. Thus, the present description further includes a container, in which the container includes the coated paperboard of the present description.

The coated paperboard may be manufactured by applying a first aqueous barrier coating over a first side of a recycled paperboard substrate, wherein the first aqueous barrier coating is formed from a mixture of binder and pigment, and applying a second aqueous barrier coating over the first aqueous barrier coating, wherein the second aqueous barrier coating is formed from a mixture of binder and pigment. The recycled paperboard substrate may be an uncoated recycled paperboard substrate or a coated recycled paperboard substrate having a basecoat thereon, wherein the first aqueous barrier coating is applied over the basecoat. The first aqueous barrier coating may be applied, for example, with a rod coater. The second aqueous barrier coating may be applied with, for example, an air knife. However other coater types may be used instead for the first aqueous barrier coating or the second aqueous barrier coating, including but not limited to curtain coater, blade coater, film coater, short-dwell coater, spray coater, and metering film size press. Furthermore, the coating can either be applied on a paper machine or by an off-line coater. The method may include any one or more of the previously described features of the coated paperboard.

Experimental Examples

Table 1 lists raw materials used in the aqueous barrier coatings of the experimental examples.

TABLE 1

| Material | ID | Product (Source) | Description |
|---|---|---|---|
| Pigment | Clay (CL-1) | Lopaque M (Thiele Kaolin, Sandersville, GA) | Kaolin Clay |
| Pigment | Clay (CL-2) | Capim DG (Imerys, Atlanta, GA) | Kaolin Clay |
| Binder | Vinyl Acrylic (VA-1) | POLYCO 3103 NA (Dow Chemical, Midland, MI) | Latex, Vinyl Acrylic Copolymer |
| Co-binder | Starch (S-1) | PenCote D - UHV (Ingredion, Cedar Rapids, IA) | Specialty Starch |
| Additive | Additive (A-1) | Rhoplex E-2961 (Dow Chemical, Midland, MI) | Viscosity Modifier, Alkali-swellable emulsion |
| Additive | Additive (A-2) | RM232D (Dow Chemical, Midland, MI) | Viscosity Modifier, Alkali-swellable emulsion |
| Additive | Additive (A-3) | Bacote XL (Luxfer MEL Technologies) | Insolubilizer, Ammonium Zirconium Carbonate |

Table 2 lists coating formulations for the aqueous barrier coatings of the experimental examples.

TABLE 2

| Formulation (in Parts) | Barrier Coating (BC-1) | BC-2 |
|---|---|---|
| Clay (CL-1) | 100 | 100 |
| Clay (CL-2) | | |
| Binder (VA-1) | 40.5 | 40.5 |
| Co-binder (S-1) | | |
| Additive (A-1) | 0.12 | 0.12 |
| Additive (A-2) | | |
| Additive (A-3) | 0.65 | |

Table 3 lists tests results for paperboard coated with the aqueous barrier coatings of the experimental examples. The paperboard substrates were 20 pt or 26 pt, ReNew 100 HS, uncoated raw stock, from Stroudsburg mill of WestRock. The aqueous barrier coatings were coated by the following coating method. The paperboard was coated by a rod coater for the first layer of barrier coating and by an air-knife coater for the second layer of barrier coating.

TABLE 3

| | Sample ID | | |
|---|---|---|---|
| | 1 | 2 | 3 |
| Substrate | 20 pt | 26 pt | 26 pt |
| Barrier Coat | BC-1 | BC-2 | BC-2 |
| Barrier coat weight - two layers (lb/3000F2) | 10.6 + 8.4 | 6.8 + 8.8 | 9.0 + 9.9 |
| 3M kit (1-12) | 11.5 | 12 | 12 |
| Oil Cobb (g/m2-30 min) | 0.7 | 0.9 | 0.8 |
| Water Cobb (g/m2-2 min) | 35.3 | 44.1 | 42.2 |
| WVTR - 38° C., 90% RH (g/m2-d) | 584.9 | 612.0 | 549.5 |
| Repulpability* (% accepts) | 97.3 | 98.1 | 96.7 |

As a control, the uncoated 26 pt ReNew 100 HS raw stock showed a % accepts of 97.5% from repulpability test.

Although various embodiments of the disclosed coated paperboard and method for manufacturing a coated paperboard have been shown and described, modifications may occur to those skilled in the art upon reading the specification. The present application includes such modifications and is limited only by the scope of the claims.

What is claimed is:

1. A coated paperboard comprising:

a recycled paperboard substrate having a first side and a second side, wherein the recycled paperboard substrate is produced from at least 50%, by weight, recovered fibers;

a first layer of aqueous barrier coating applied over the first side, wherein the first layer of aqueous barrier coating comprises a first mixture of binder and pigment, wherein the binder of the first layer of aqueous barrier coating is present in the first mixture in an amount of 30 to 50 parts per 100 parts of pigment by weight; and a second layer of aqueous barrier coating applied over the first layer of aqueous barrier coating, wherein the second layer of aqueous barrier coating comprises a second mixture of binder and pigment, wherein the binder of the second layer of aqueous barrier coating is present in the second mixture in an amount of 30 to 50 parts per 100 parts of pigment by weight, wherein the coated paperboard has a 3M kit test value of at least 5, a 30-minute oil Cobb test of at most 5 grams per square meter, a 2-minute water Cobb of less than 60 grams per square meter, a water vapor transmission rate of less than 800 grams per square meter per day, and is repulpable to the extent that after repulping the percentage accepts is at least 85%.

2. The coated paperboard of claim 1, wherein the recycled paperboard substrate is produced from at least 90%, by weight, recovered fibers.

3. The coated paperboard of claim 1, wherein the recycled paperboard substrate has a caliper thickness of at least 4 points (0.004 inch).

4. The coated paperboard of claim 1, wherein the recycled paperboard substrate has a caliper thickness of ranging from 4 points to 36 points (0.004 inch to 0.036 inch).

5. The coated paperboard of claim 1, further comprising a basecoat layer between the first side of the recycled paperboard substrate and the first layer of aqueous barrier coating.

6. The coated paperboard of claim 5, wherein the basecoat layer comprises a third mixture of binder and pigment.

7. The coated paperboard of claim 5, wherein the basecoat layer comprises a third mixture of binder and pigment, wherein the binder of the basecoat layer is present in the mixture in an amount of 5-35 parts per 100 parts of pigment by weight.

8. The coated paperboard of claim 5, wherein the basecoat layer comprises a third mixture of binder and pigment, wherein the binder of the basecoat layer comprises at least one of latex binder and natural binder.

9. The coated paperboard of claim 5, wherein the basecoat layer comprises a third mixture of binder and pigment, wherein the pigment of the basecoat layer comprises one or more of clay, calcium carbonate, and titanium oxide.

10. The coated paperboard of claim 5, wherein the basecoat layer has a coat weight from 2 to 14 pounds per 3000 $ft^2$.

11. The coated paperboard of claim 1, wherein the binder of the first layer of aqueous barrier coating comprises latex.

12. The coated paperboard of claim 1, wherein the first layer of aqueous barrier coating further comprises a natural co-binder.

13. The coated paperboard of claim 1, wherein the first layer of aqueous barrier coating comprises an additive, wherein the additive is present in the first mixture in an amount of up to 4 parts per 100 parts of pigment by weight.

14. The coated paperboard of claim 1, wherein the binder of the second layer of aqueous barrier coating comprises latex.

15. The coated paperboard of claim 1, wherein the second layer of aqueous barrier coating further comprises a natural co-binder.

16. The coated paperboard of claim 1, wherein the second layer of aqueous barrier coating comprises an additive, wherein the additive is present in the second mixture in an amount of up to 4 parts per 100 parts of pigment by weight.

17. The coated paperboard of claim 1, wherein a 3M kit test value is at least 6.

18. The coated paperboard of claim 1, wherein the coated paperboard has a 30-minute oil Cobb test of at most 3 grams per square meter.

19. The coated paperboard of claim 1, wherein the coated paperboard has a water vapor transmission rate of less than 700 grams per square meter per day.

20. The coated paperboard of claim 1, wherein the coated paperboard is repulpable to the extent that after repulping the percentage accepts is at least 90%.

21. A container, the container comprising the coated paperboard of claim 1.

22. A method for manufacturing coated paperboard, the method comprising:

applying a first layer of aqueous barrier coating over a first side of a recycled paperboard substrate, wherein the first layer of aqueous barrier coating comprises a first mixture of binder and pigment, wherein the binder of the first layer of aqueous barrier coating is present in the first mixture in an amount of 30 to 50 parts per 100 parts of pigment by weight, wherein the recycled paperboard substrate is produced from at least 50%, by weight, recovered fibers; and applying a layer of second aqueous barrier coating over the first layer of aqueous barrier coating, wherein the second layer of aqueous barrier coating comprises a second mixture of binder and pigment, wherein the binder of the second layer of aqueous barrier coating is present in the second mixture in an amount of 30 to 50 parts per 100 parts of pigment by weight, wherein the coated paperboard has a 3M kit test value of at least 5, a 30-minute oil Cobb test of at most 5 grams per square meter, a 2-minute water Cobb of less than 60 grams per square meter, a water vapor transmission rate of less than 800 grams per square meter per day, and is repulpable to the extent that after repulping the percentage accepts is at least 85%.

23. A coated paperboard comprising:

a recycled paperboard substrate having a first side and a second side, wherein the recycled paperboard substrate is produced from at least 50%, by weight, recovered fibers;

a first layer of aqueous barrier coating applied over the first side, wherein the first layer of aqueous barrier coating comprises a first mixture of binder and pigment, wherein the binder of the first layer of aqueous barrier coating is present in the first mixture in an amount of 30 to 50 parts per 100 parts of pigment by weight, wherein the first layer of aqueous barrier coating includes an additive, wherein the additive is a viscosity modifier; and a second layer of aqueous barrier coating applied over the first layer of aqueous barrier coating, wherein the second layer of aqueous barrier coating comprises a second mixture of binder and pigment, wherein the binder of the second layer of aqueous barrier coating is present in the second mixture in an amount of 30 to 50 parts per 100 parts of pigment by weight, wherein the coated paperboard has a 3M kit test value of at least 5, a 30-minute oil Cobb test of at most 5 grams per square meter, a 2-minute water Cobb of less than 60 grams per square meter, a water vapor transmission rate of less than 800 grams per square meter per day, and is repulpable to the extent that after repulping the percentage accepts is at least 85%.

24. A method for manufacturing coated paperboard, the method comprising:

applying a first layer of aqueous barrier coating over a first side of a recycled paperboard substrate, wherein the recycled paperboard substrate is produced from at least 50%, by weight, recovered fibers, wherein the first layer of aqueous barrier coating comprises a first mixture of binder and pigment, wherein the binder of the first layer of aqueous barrier coating is present in the first mixture in an amount of 30 to 50 parts per 100 parts of pigment by weight, and wherein the first layer of aqueous barrier coating includes an additive, wherein the additive is a viscosity modifier; and applying a second layer of aqueous barrier coating over the first layer of aqueous barrier coating, wherein the second layer of aqueous barrier coating comprises a second mixture of binder and pigment, wherein the binder of the second layer of aqueous barrier coating is present in the second mixture in an amount of 30 to 50 parts per 100 parts of pigment by weight, wherein the coated paperboard has a 3M kit test value of at least 5, a 30-minute oil Cobb test of at most 5 grams per square meter, a 2-minute water Cobb of less than 60 grams per square meter, a water vapor transmission rate of less than 800 grams per square meter per day, and is repulpable to the extent that after repulping the percentage accepts is at least 85%.

25. The coated paperboard of claim 1, wherein the recycled paperboard substrate is produced from at least 99%, by weight, recovered fibers.

* * * * *